United States Patent [19]

Hartman

[11] 4,305,408

[45] Dec. 15, 1981

[54] AUTOMATIC CIGAR WRAPPING DEVICE

[75] Inventor: Jack F. Hartman, Barrington, N.J.

[73] Assignee: Gulf & Western Industries, Inc., New York, N.Y.

[21] Appl. No.: 140,181

[22] Filed: Apr. 14, 1980

[51] Int. Cl.[3] ..... A24C 1/30

[52] U.S. Cl. ..... 131/32; 131/51; 53/211

[58] Field of Search ..... 131/32–37, 131/59, 105, 58; 53/211, 214; 93/1 C, 80

[56] References Cited

U.S. PATENT DOCUMENTS 3,340,878 9/1967 Pallach et al. ..... 131/105
3,794,048 2/1974 Molins et al. ..... 131/36 X
4,103,692 8/1978 Baier et al. ..... 131/32

FOREIGN PATENT DOCUMENTS 662087 7/1938 Fed. Rep. of Germany .
1432681 4/1970 Fed. Rep. of Germany .

*Primary Examiner*—Stephen C. Pellegrino
*Attorney, Agent, or Firm*—Meyer, Tilberry & Body

[57] ABSTRACT

A device for applying a chevron-shaped cigar wrapper blank onto a rotating double cigar body as the body is being rotated in a mechanically driven nest where certain driving rods of the nest are modified to provide clearance for a tuck lifter that initiates the wrapping procedure.

10 Claims, 7 Drawing Figures

AUTOMATIC CIGAR WRAPPING DEVICE

The present invention relates to the art of automatically wrapping cigars with a decorative wrapper and more particularly to an improved automatic cigar wrapping device.

PRIOR PATENT AND APPLICATIONS

U.S. Pat. No. 4,103,692 is assigned to the assignee of this application. Also owned by the present assignee are copending prior U.S. patent applications Ser. No. 973,037, filed Dec. 26, 1978 and Ser. No. 95,096, filed Nov. 16, 1979. The prior patent and prior applications are incorporated herein by reference.

BACKGROUND OF THE INVENTION

The present invention relates to the art of spirally winding cigar wrappers around a cigar body or bunch to provide the desired outer appearance. For many years this procedure has been done by rotating the cigar body and feeding a wrapper at a wrapping angle onto the body or bunch. As the body is rotated, it pulls the wrapper into the desired spiral configuration. In this process, only a single cigar can be wrapped at a given time and each cigar must be manually loaded into the rotating mechanism preparatory to wrapping. Consequently, the wrapping procedure used for many years has had a high labor cost component. Such labor costs continue to rise at the same time that the price commanded by a majority of cigars is relatively low. In this business environment, there has been a tremendous impetus for mechanizing all aspects of cigar making, including the wrapping of a wrapper around the cigar body. Automatic machine concepts for performing the wrapping procedure are disclosed in U.S. Pat. No. 4,103,692. In accordance with these concepts, a number of cigar bodies are rotated as they are moved along a given path. In this path, a conveyor means delivers cigar wrappers to the rotating and translating cigar body. When the wrapper converges with the body, it engages the body and the wrapping process continues until the cigar is completed. At the end of the wrapping process, the flag end of the wrapper is formed onto a generally tapered end of the body to provide the mouth end of the resulting cigar. In this prior U.S. patent two separate wrappers formed into a chevron-shape are wrapped onto a dual cigar body. After wrapping, the cigar body is cut at the midsection to produce two finished cigars, each of which has a fire end and a mouth end. By mechanizing the procedure for wrapping and wrapping two wrappers onto a double cigar body, relatively high production rates can be obtained. Thus, this concept provides an automatic procedure for wrapping cigars which is low in labor cost and has high production rates. Since such equipment involves a tremendous amount of development work and capital expenditures, these machines must operate with a minimum of down time and rapidly. This goal is being realized in automatic wrapping machines of the general type shown in this prior patent. In accordance with the illustrated concept of FIGS. 37–39 of this prior patent, it has been suggested that the cigar bodies can be carried in individual nests which are formed from a plurality of mutually parallel rods that capture and engage the cigar body. As the nest is moved along a given path, the rods of the nest are driven to rotate the cigar body carried by the moving nest. A wrapper is brought into engagement with the cigar body where the tuck end is affixed to the surface of the body so that continued rotation of the body by the parallel rods wraps the wrappers onto the outer surface for the purpose previously described.

To start this wrapping process, it has been suggested that an arrangement on the wrapper conveyor be used to lift the truck end of both wrappers into engagement with the cigar body. This is illustrated in prior application Ser. No. 973,037, filed Dec. 26, 1978. This lifting device called a tuck lifter or tuck lifting means, forces the tuck ends of the wrappers into engagement with the rotating body as the apex of the chevron-shaped dual wrapper blank is directly between the two lower rods of the nest. This apex often includes a small deposit of glue so that the wrappers are positively secured to the body to initiate the wrapping operation. This procedure has been successful and is now being developed for commercial application.

Since the speed of the machine must be increased to a level which makes the machine economically feasible, various control arrangements on the wrapping machine must be done rapidly. Often movements are accomplished by a vacuum system, a pressurized air system or a cam mechanism. In the prior automatic wrapping machine, one critical aspect was the movement of the tuck lifter up into a position contacting the wrapper and the body rotated in the nest. This had to be done at the exact instance when the body and wrapper blank converged. This requirement necessitated relatively close port construction and mechanical adjustments for the machine developed to accomplish the automatic wrapping of a chevron-shaped wrapper blank onto the dual cigar body.

THE PRESENT INVENTION

The present invention relates to an improvement of the machine as described above which improvement relates to a modification of the nest to reduce the criticality of the operation of the tuck lifter. Such a change has resulted in a substantial reduction in down time and more uniform results together with a reduction in the adjustment and cost of the rapidly cycled automatic wrapping machine. In accordance with the present invention, a wrapping machine of the type described above is improved by employing an axially extending clearance gap for the tuck lifter member in two driving rods of the nest. These gaps in the rods are generally at the midsection of the cigar body. They are aligned with the apex of the cigar wrapper blank as it is forced from its conveyor to the cigar body to initiate the wrapping operation. These gaps have axial lengths greater than the axial length of the tuck lifter. Consequently, the tuck lifter can move into an operative position without interfering with the movement of the nest along its preselected path. The gaps can be formed by reducing the diameters of the drive rods at the midsection of the body or by forming each of the rotating rods as separate, spaced rod portions. As the tuck lifter or lifting member forces the tuck portion of the wrapper into engagement with the body, it has an opportunity to engage either of the two outboard driving rods used in rotating the cigar body. Thus, the criticality of timing is reduced and the manufacturing tolerances can be increased. In addition, the tuck lifting member can be relatively large since it does not tend to interfere with the nest as the nest is moving at a different rate than the rate of the conveyor upon which the wrapper is brought into engagement with the cigar body. Consequently, by providing these clearance areas or gaps, a more uniform result can be accomplished with a tuck lifter that can be relatively large and held into the operative position for the desired amount of time which negates the criticality of the synchronization between the operation of the tuck lifter and the movement of the nest. Also, there is no need to operate the lifter rapidly or move the nest slowly.

The primary object of the present invention is the provision of an improvement in an automatic wrapping machine of the type wherein a cigar wrapper is spirally wound around a cigar body, which improvement reduces the criticality of tolerances, timing and size of the tuck lifter used to force the tuck portion of the wrapper into engagement with the rotating body of the cigar.

Another object of the present invention is the provision of an improvement as defined above, which improvement can be incorporated in various types of cigar wrapping machines.

Still a further object of the present invention is the provision of an improvement in the tuck lifting portion of an automatic cigar wrapping machine, which improvement can be used with any of several types of tuck lifters, wrapper conveyors and driven nests.

These and other objects and advantages will become apparent from the description which will incorporate drawings as described below.

PREFERRED EMBODIMENT

Figure 1:
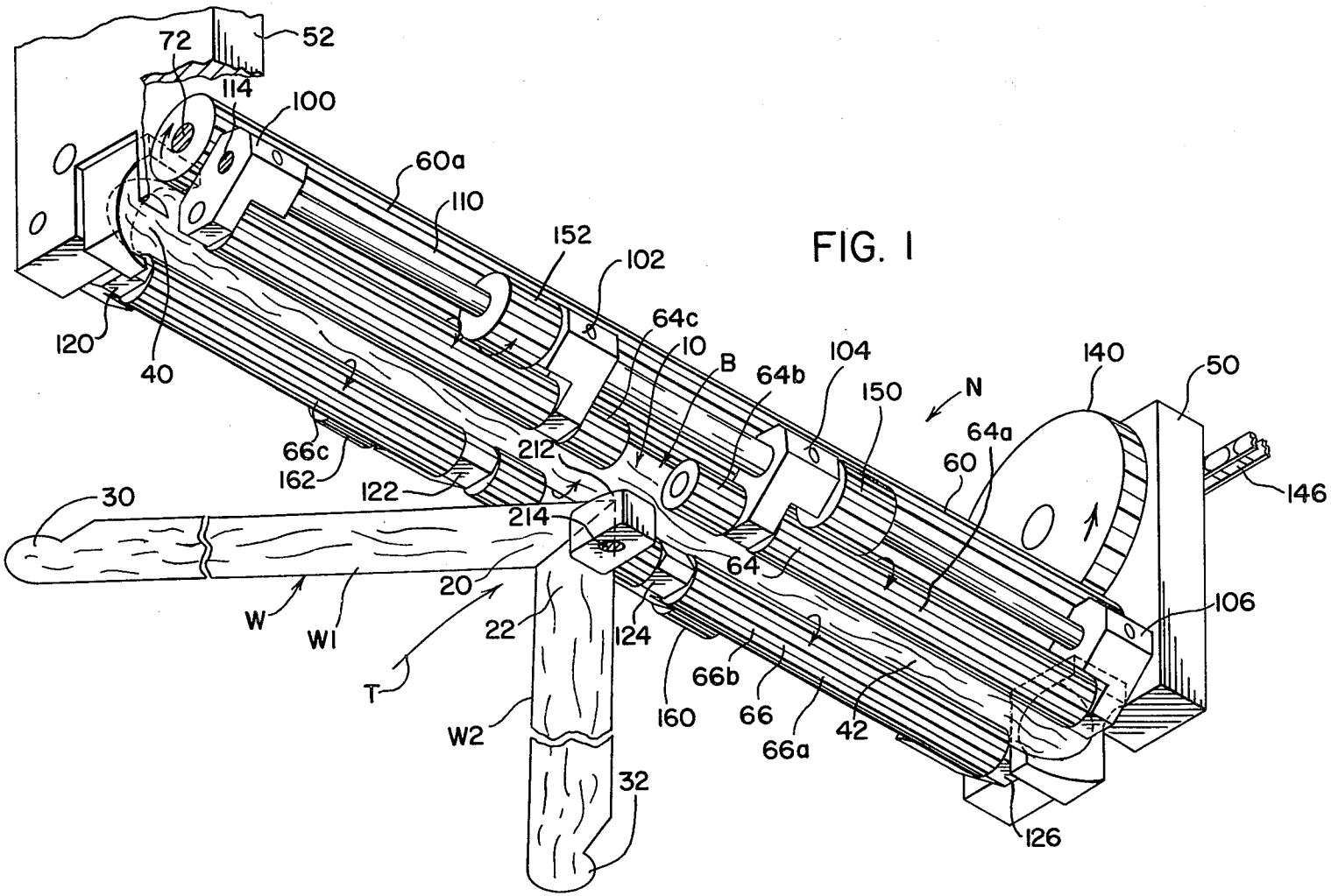
FIG. 1 is a pictorial view illustrating the preferred embodiment of the present invention.
Figure 6:
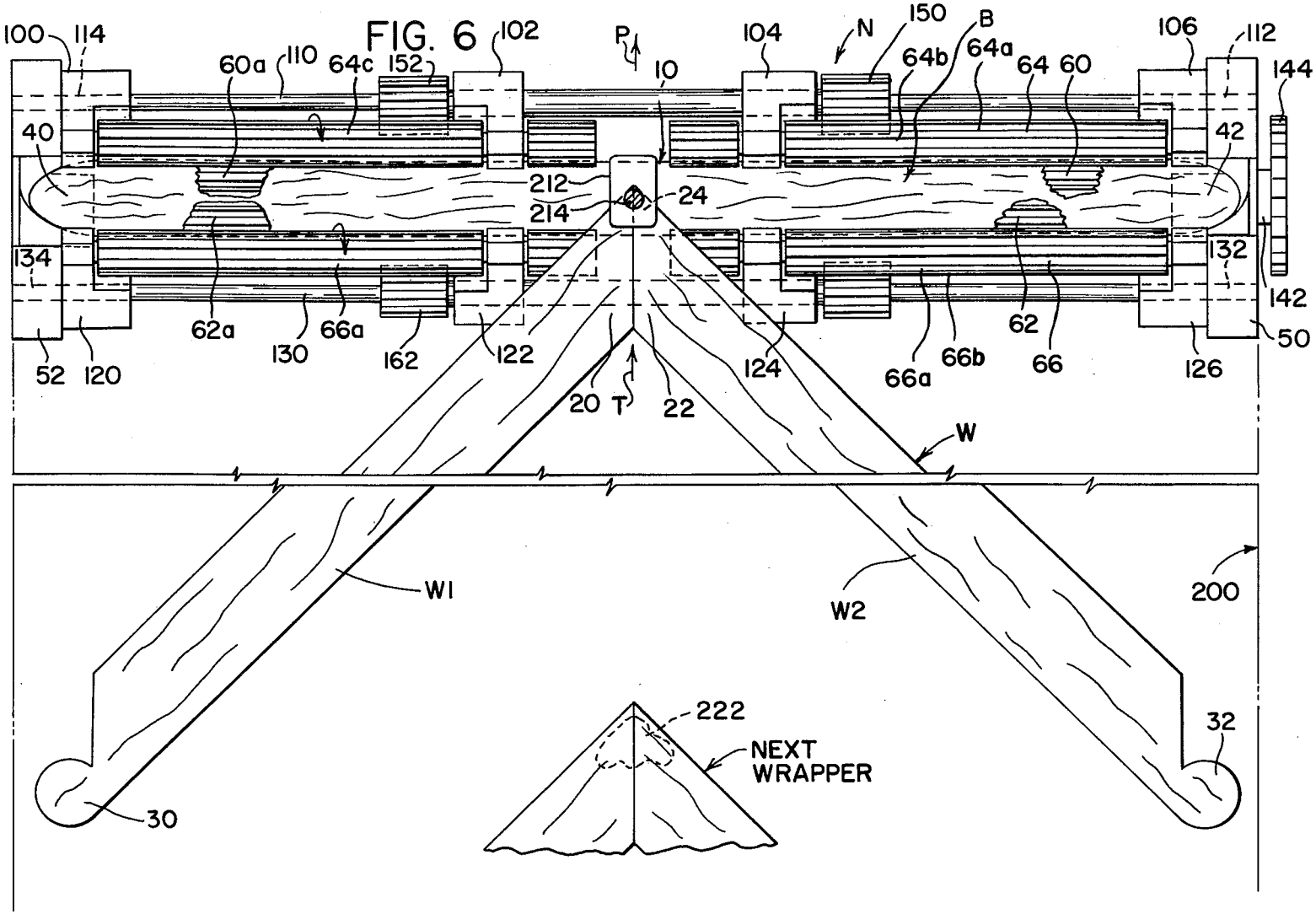
FIG. 6 is a bottom plan view taken generally along lines 6—6 of FIG. 2; and, FIG. 7 is a geometric diagram indicating an operating aspect of the present invention.

The present invention relates to an improvement in an apparatus for wrapping a wrapper around a cigar body. In the preferred embodiment of the invention, the wrapper is a chevron-shaped blank W which includes two separate wrappers W1, W2 to be wrapped around a double cigar body B to form a dual cigar which is ultimately cut at midsection 10 to form two cigars. Each of the resulting cigars includes a flat fire end and a tapered mouth end. Since two cigars are produced by the illustrated embodiment of the invention, wrapper blank W, as shown in FIGS. 1 and 6, includes two diverging wrappers W1, W2 having tuck ends 20, 22, respectively, which abut each other to form an apex 24. The flat cigar wrappers, which may be formed from natural tobacco leaves or synthetic material, include elongated portions terminating in standard flag ends 30, 32. By wrapping chevron-shaped blank W around dual or double cigar body B, the body ultimately receives the flag ends 30, 32 at tapered mouth ends 40, 42, respectively. The flag end is wrapped around the mouth end. This is standard practice. In certain newly developed automatic machines for wrapping cigars mechanically, there is provided a nest formed from several generally parallel rods which capture cigar body B and rotates the body in the direction of the arrows shown in FIG. 1. By rotating the several encircling rods forming the nest N in unison, the body is rotated. In accordance with general practice, nest N is moved along path P which may be a circular path, a curvilinear path or straight path by carrying the nest N on a guided chain or a rotating drum, to name two arrangements. Several nests N are incorporated in an automatic machine so that more than one cigar body B is being wrapped with a blank W at any given time. In this manner, several cigars are being wrapped simultaneously as the respective nests N move along a preselected path P. The mechanism for moving the nest N along path P does not form a part of the invention and is fully described in the previously mentioned United States Letters Patent. In accordance with the illustrated embodiment of nest N, two spaced end or support plates 50, 52 are movable in unison along path P and are joined together by elongated rods. Four rods or rolls capture body B and then rotate the body during at least the wrapping operation. As is illustrated, two relatively large, upper rolls or rods 60, 62 are fixed with respect to end plates 50, 52 and are journalled therein. Two smaller lower rods 64, 66 are adapted to open to allow insertion of a cigar body B prior to the wrapping operation and are closed to capture and allow rotation of the body by the combined rotary action of rolls 60, 62, 64 and 66 as they are rotated in unison in a manner to have the outer cylindrical surfaces of the various rods engaging and frictionally driving the body during the wrapping operation.

Referring now more specifically to lower, relatively smaller rods 64, 66, these rods are modified in accordance with the preferred embodiment of the invention to be constructed of two separate axially spaced segments; however, they will be explained with respect to the operation of nest N as single rods adapted to open and close for capturing and rotating body B in accordance with standard practice. The fact that the rods are divided at the center, in accordance with an aspect of the invention, will not affect the general discussion of nest N. In this nest, rods 60, 62, 64 and 66 have outer cylindrical, body engaging surfaces 60*a*, 62*a*, 64*a* and 66*a*, respectively. These surfaces, in the illustrated embodiment, are elongated gear teeth. Rods 60, 62 are fixed with respect to spaced support plates 50, 52 as was previously mentioned. Rod 60 is rotatable about outwardly extending stub shafts 70, 72 which are journalled within and secured to the end plates 50, 52, respectively. Rod 62 is secured to the end plates in the same manner so that the rods are rotatable in a fixed relationship with plates 50, 52 forming the support structures of moving nest N. Various arrangements for journalling rods 60, 62 within the end plates and the relationship between the end plates can be employed without departing from the invention.

Rod 64 is separated into two sections or subrods 64*b*, 64*c* to define a gap G at midsection 10 when body B is captured within nest N. These subrods 64*b*, 64*c* are rotatable on pivotally mounted, axially spaced brackets 100, 102, 104 and 106 which pivot about support shaft 110 extending between end plates 50, 52 and supported on these end plates by stub shafts 112, 114. In this manner, rod 64, formed by spaced subrods 64*b*, 64*c* can be pivoted outwardly on brackets 100–106 to allow insertion or removal of body B into and from nest N. After insertion, body B is moved toward the wrapping position of the wrapping machine. By pivoting rod 64 back into engagement with body B, the body is captured in nest N for rotation during the wrapping operation. In a like manner, rod 66 is formed into two sections or subrods 66*b*, 66*c* to form gap G at midsection 10 of body B. This is clearly illustrated in FIG. 1 wherein the gaps in rods 64, 66 correspond in an axial direction. Sections 66*b*, 66*c* are supported on axially spaced brackets 120, 122, 124 and 126 to pivot about a support shaft 130 extending between end plates 50, 52 and supported on the end plates by stub shafts 132, 134. Thus, support shafts 110, 130 are fixed with respect to the end plates as are the upper, relatively large driven shafts 60, 62. The surfaces of rods 64, 66 are also illustrated as elongated gear teeth. Of course, other surfaces could be provided on the drive rods. The surface speed of rods 60–66 are coordinated by gearing to be substantially the same.

Figure 3:
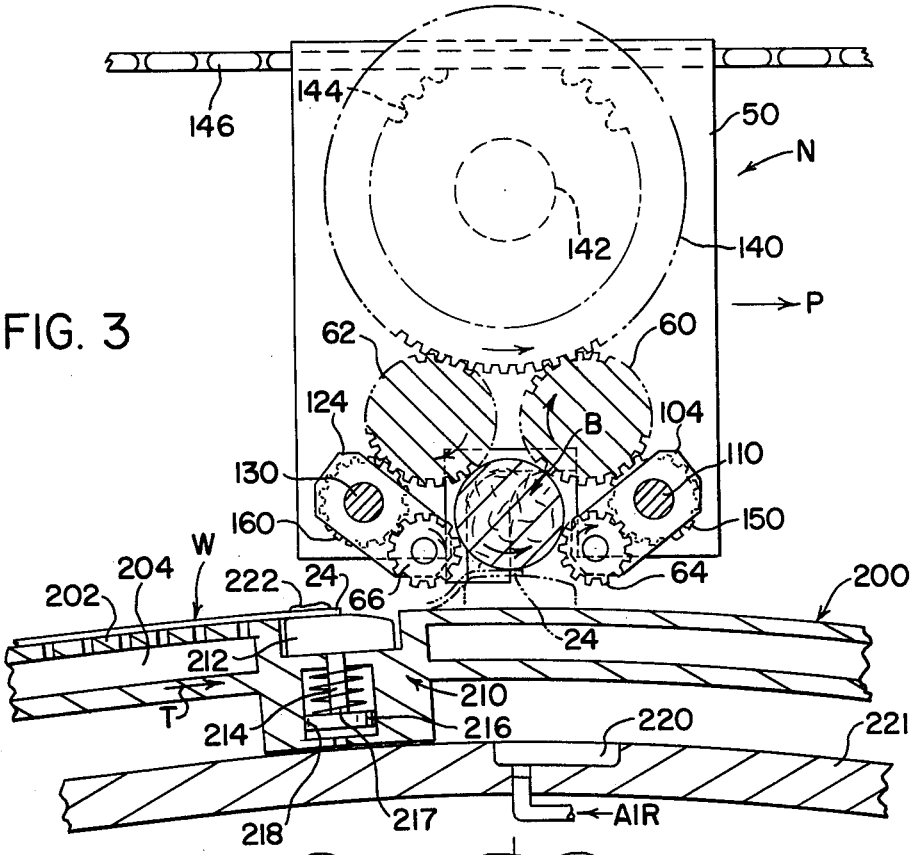
FIG. 3 is an enlarged view taken generally along lines 3—3 of FIG. 2.

As so far explained, rods 60, 62, 64 and 66 allow nest N to accept a cigar body and capture the body for subsequent rotation during the wrapping operation. A variety of mechanisms could be used for rotating various rods having outer cylindrical surfaces engaging body B. In accordance with the illustrated embodiment, a drive gear 140 includes a shaft 142 that journals gear 140 in end plate 50. A sprocket 144 is secured to the outboard portion of shaft 142 and engages a moving chain 146. By movement of the chain with respect to end plate 50, driven gear 140 is rotated as shown in FIG. 3. Each of the shafts or rods previously discussed employs elongated gear teeth which are interconnected at the ends thereof adjacent support plates 50, 52, as illustrated in FIG. 3. The gearing arrangement for driving the rods 60–66 in the direction of the arrows of FIG. 3 includes idler gears 150, 152 on opposite ends of support shaft 110 to form a motion reversing mechanism between the rotation of upper relatively large rod 60 and lower relatively small rod 64. In this manner, shaft 110 defines the pivotal center or axis of rod 64 so that it may be opened and closed without releasing the driving relationship between the various gear teeth at the terminal ends of the rods used in nest N. In a like manner, idler gears 160, 162 are secured at the remote ends of shaft 130 so that the shaft can form the pivotal center or axis of rod 66 as the rod is opened and closed for accepting and then capturing a cigar body B.

As described above, rods 64, 66 are pivoted outwardly by pivoting their support brackets outwardly to accept a cigar body before it reaches the position shown in FIG. 3. This action is done by a camming mechanism. Such a mechanism is generally standard in the wrapping machine to which the present invention is directed. The camming arrangement for opening rods 64, 66 is not disclosed for the purposes of simplicity. After the rods are opened and the body has been placed into nest N, the brackets of rods 64, 66 are released so that they capture body B, as illustrated in FIG. 3. In this position, the wrapping operation is ready to commence.

Figure 2:
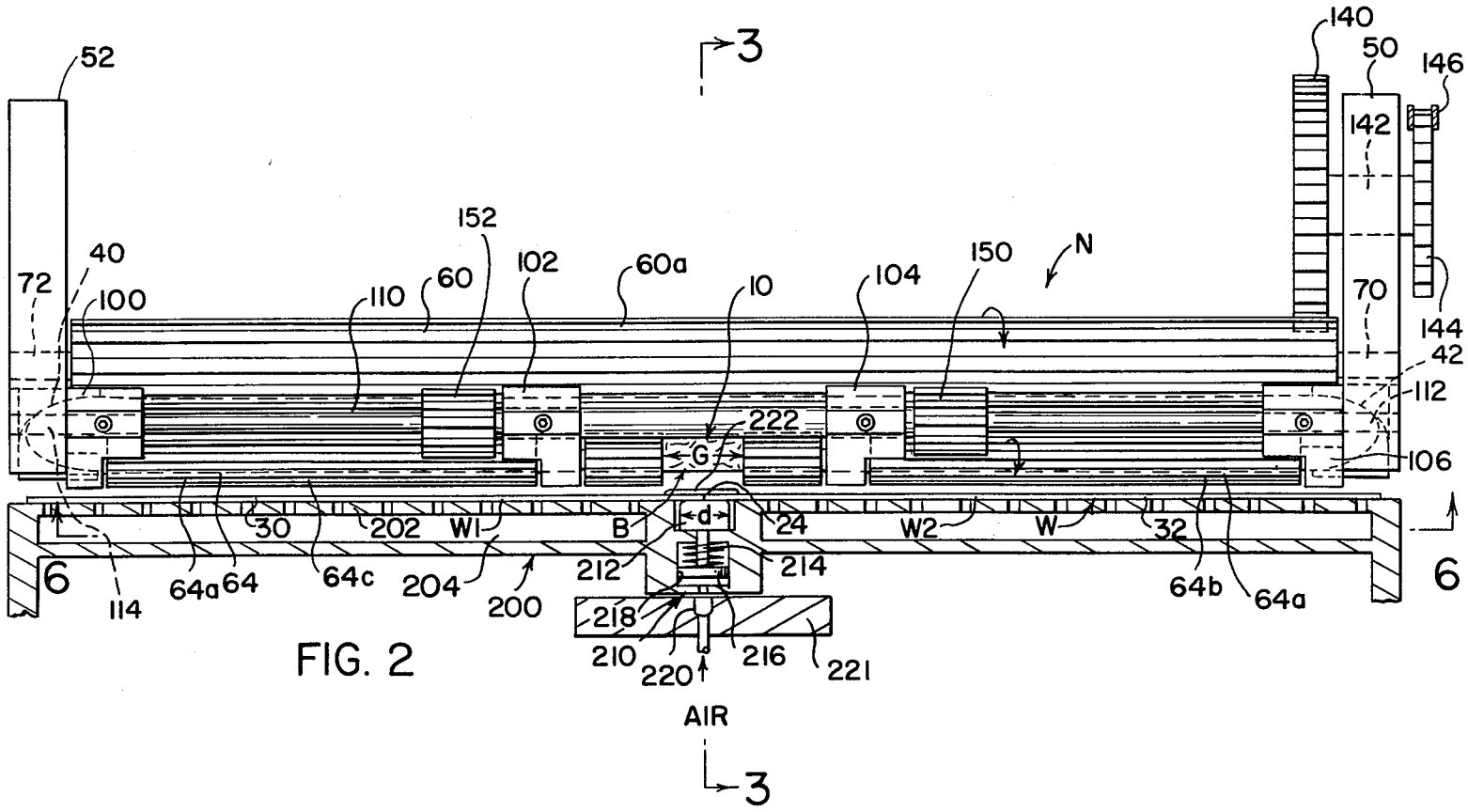
FIG. 2 is a side elevational view of the structure shown in FIG. 1.
Figure 4:
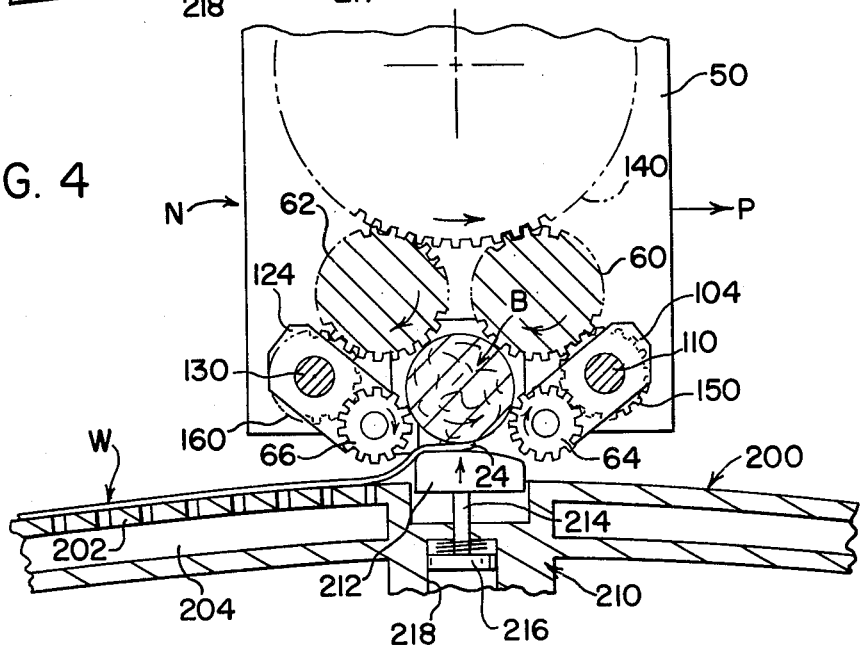
FIGS. 4 and 5 are views similar to FIG. 3 illustrating operating characteristics of the preferred embodiment of the present invention.
Figure 5:
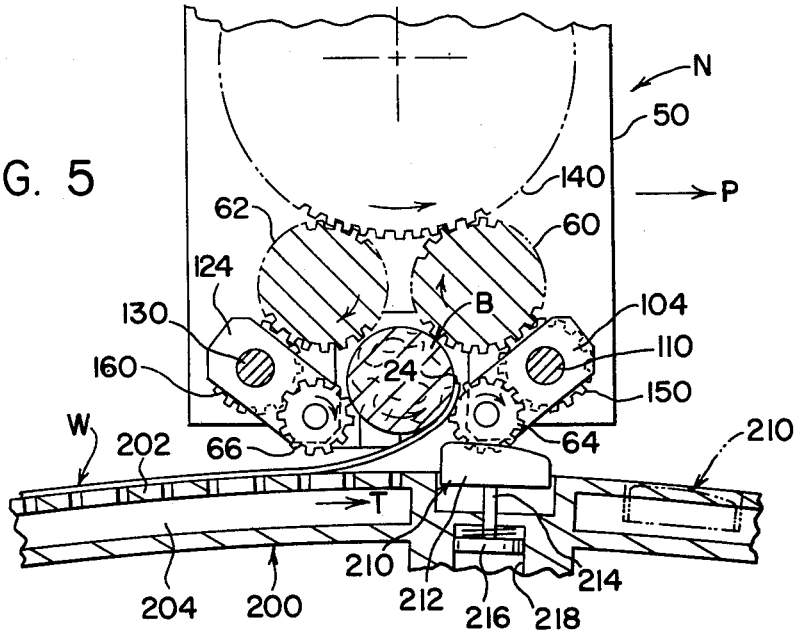

To wrap blank W around cigar body B, the blank is brought to a position with apex 24 at midsection 10. In practice, an applicator applies a small amount of adhesive or glue 222 on apex 24 at a position facing midsection 10 prior to the conveying of blank W into the wrapping position, best shown in FIG. 4. Various mechanisms can be used for conveying blank W into a converging position with body B as nest N is moving. These conveyors include belts, platens, or drums, to name three. Blank W is generally held in the positions shown in the drawings by a vacuum system. The conveyor mechanism is schematically illustrated as the drum 200 movable in a circular path T, as best illustrated in FIGS. 3–5, and including an upper perforated plate 202 communicated with vacuum chamber 204. Conveyor mechanism 200 carries a tuck lifter 210, which is used to shift tuck ends 20, 22 at apex 24 against rotating body B at the position of convergence shown generally in FIG. 4. Although the tuck lifter can include various mechanisms for moving a lift element upwardly from the conveyor 200 to force apex 24 against body B, the illustrated tuck lifter includes lift member 212 movable by various arrangements from a lower position, shown in FIG. 3, to an upper position, shown in FIGS. 4 and 5. In this upper position, the extended height of member 212 is inward of the cylindrical area generally defined by the outer surfaces of lower rods 64, 66. Thus, in the past, it was necessary to accurately time the upward movement of member 212 so that the lifting action would take place between rods 64, 66 at the position shown in FIG. 4. The movable member would have to be moved to the down position when conveyor 200 was in the positions shown in FIGS. 3 and 5. By providing the gaps G, as shown in FIGS. 1 and 2, lift member 212 can remain in the upper operative position as conveyor 200 moves between the position shown in FIGS. 3 and 5. Thus, the size of the tuck lifter is less critical, the timing is less critical and the lifting operation can take place over a prolonged arcuate path or time. These features greatly simplify the design of the apparatus as shown in the illustrated embodiment.

Although various arrangements could be used to shift member 212 from a lower inactive position to an upper operative position, the illustrated embodiment includes a stem 214 extending downwardly from member 212 and terminating in a lower piston 216 biased by spring 217 downwardly in a pressure chamber 218. In the lifting position, a lower air orifice or arcuate slot 220 in a fixed member 221 is exposed to the chamber 218. This forces member 212 into the upper active or operative position, as shown in FIGS. 4 and 5. To prevent rotation of member 212 it is not lifted completely out of its recess in conveyor 200. Of course, lifter 210 could be a mechanical device which is cammed upwardly for lifting apex 24. Also, a vacuum system could be employed for lifting the tuck ends 20, 22. Since member 212 has an axial length d, as shown in FIG. 2, which is less than the axial lengths of gaps G and tuck lifter 210 is aligned with these gaps, there is no interference between the tuck lifter and outer cylindrical surfaces of lower support rods 64, 66.

The operation of the invention as so far described is quite apparent from the structure illustrated in FIGS. 3–5. As blank W approaches the wrapping position, shown in FIG. 4, member 212 is in the lower position shown in FIG. 3. At this time, member 212 can be moved upwardly, as shown in FIG. 4, without interference with the outer surface of rod or roll 66. This is shown in FIG. 4. In this position, glue 222 adheres apex 24 to rotating body B. Thereafter, moving nest N continues, as shown in FIG. 5, which causes the rotating body B to pull wrapper W away from conveyor 200 and onto the outer cylindrical surface of body B. Of course, the linear speed of conveyor 200 must be timed to a speed greater than the nest N since the rear end portions of blank W must overtake body B during the winding operation. As can be seen, the tuck lifter 210 does not interfere with the lower rolls 64, 66 in the lifting operation. The advantages of this invention have been previously described.

Figure 7:
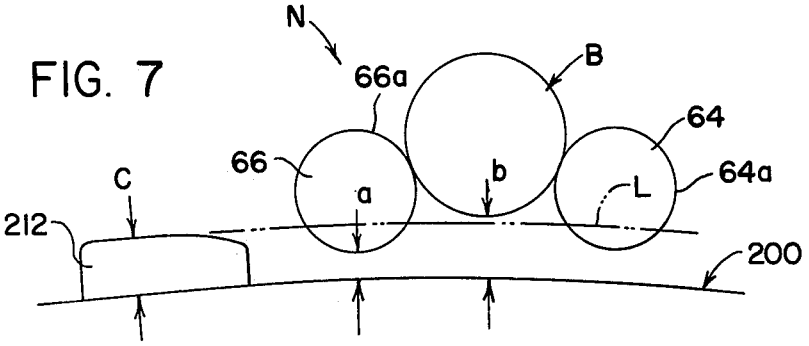

Referring now briefly to FIG. 7, the geometry of the present invention is schematically illustrated. As can be seen, the general spacing between the outer surface 66*a* of rod 66 and the outer surface of conveyor 200 is dimension a. This is substantially less than the spacing b between the lowermost portion of body B and the outer surface of conveyor 200 when they are at the point of convergence. The upper operative position of member 212 requires that the upper surface of the member extends from the surface of conveyor 200 a distance c. As can be seen, the distance c is substantially greater than the distance a and generally corresponds to the spacing b. Thus, projected arcuate construction line L, which is the upper projected position of member 212, intersects the normal surface 66*a* of rod 66. By providing gaps in rod 66 to clear member 212, the necessary dimensional relationship for the wrapping operation does not require rapid movement of member 212. Thus, the inertia involved in the tuck lifting operation and the positive nature of the operation are benefitted for long term, trouble free operation.

Having thus described the invention, the following is claimed:

1. In a device for applying a generally chevron-shaped cigar wrapper blank having an apex and diverging, elongated legs forming individual cigar wrappers in a spiral configuration around a double cigar body having a midsection, said device comprising nest means formed from a plurality of generally parallel driven, cylindrical rods with body contacting cylindrical surfaces for rotating a cigar body captured by said rods as said nest means moves said cigar body along a selected path; conveyor means for moving a cigar wrapper blank to said path with said apex of said blank converging with said midsection of said cigar body captured in said nest means; and, lifter means on said conveyor means for lifting said apex of said wrapper blank into contact with said midsection of said cigar body, said lifting means including a member movable toward said body to an operative position inward of at least a portion of one of said rods, the improvement comprising: means for providing an axially extending clearance gap for said member in the cylindrical contacting surface of said onerod at said midsection, said gap having an axial length greater than the axial length of said member whereby said member can move into said operative position without interferring with movement of said nest means along said path.

2. The improvement as defined in claim 1 wherein said gap forming means includes means forming said one rod into two separate axially aligned subrods axially spaced from each other at said midsection by said axial length.

3. The improvement as defined in claim 2 including means for pivoting said subrods in unison between a first position opening said nest means and a second position closing said nest means.

4. The improvement as defined in claim 1 including means for pivoting said one rod between a first position opening said nest means and a second position closing said nest means.

5. The improvement as defined in claim 1 wherein said operative position is inward of at least a portion of two of said rods and including means for providing said axial extending clearance gaps for said member in the cylindrical contacting surface of said two rods at said midsection.

6. The improvement as defined in claim 5 wherein said means forming said gaps in said two rods includes means forming each of said rods into two separate axially aligned subrods axially spaced from each other at said midsection by said axial length.

7. The improvement as defined in claim 6 including means for pivoting said subrods of at least one of said two rods in unison between a first position opening said nest means and a second position closing said nest means.

8. The improvement as defined in claim 6 including means for pivoting said subrods of each of said two rods in unison between a first position opening said nest means and a second position closing said nest means.

9. The improvement as defined in claim 5 including means for pivoting said two rods between first positions opening said nest means and second positions closing said nest means.

10. In a device for applying an elongated cigar wrapper having first end and a longitudinally spaced second end in a spiral configuration around a cigar body, said device comprising nest means formed from a plurality of generally parallel driven, cylindrical rods with body contacting cylindrical surfaces for rotating a cigar body captured by said rods as said nest means moves said cigar body along a selected path, the body contacting surfaces of two of said rods projecting from said nest means beyond said captured cigar body to a given position; conveyor means for moving a cigar wrapper to said path with said first end of said wrapper converging with said cigar body captured in said nest means; and, means for lifting said first end from said conveyor means into engagement with said moving cigar body, said lifting means including a member at a given axial position and having a known overall dimension in a direction axial of said rods and selectively shiftable toward said captured body to an operative position inwardly closer to said body than said given position of said projecting surfaces, the improved comprising: at least one of said two rods having its projected surface discontinued to a depth generally exceeding said operative position at said given axial position and for a distance matching and greater than said overall length.

* * * * *